US012471685B2

(12) United States Patent
Fischer

(10) Patent No.: US 12,471,685 B2
(45) Date of Patent: Nov. 18, 2025

(54) FLAT FOLDABLE LECTERN AND ENCLOSED BRIEFCASE

(71) Applicant: Aron Fischer, Monsey, NY (US)

(72) Inventor: Aron Fischer, Monsey, NY (US)

( * ) Notice: Subject to any disclaimer, the term of this patent is extended or adjusted under 35 U.S.C. 154(b) by 505 days.

(21) Appl. No.: 17/667,642

(22) Filed: Feb. 9, 2022

(65) Prior Publication Data

US 2023/0248129 A1 Aug. 10, 2023

(51) Int. Cl.

| | |
|---|---|
| ***A45C 9/00*** | (2006.01) |
| ***A45C 3/02*** | (2006.01) |
| ***A47B 19/08*** | (2006.01) |

(52) U.S. Cl.

CPC ..... *A45C 9/00* (2013.01); *A45C 3/02* (2013.01); *A47B 19/08* (2013.01)

(58) Field of Classification Search

CPC ..... A45C 9/00; A45C 3/02; A47B 19/08
USPC ..... 190/11
See application file for complete search history.

(56) References Cited

U.S. PATENT DOCUMENTS 5,152,491 A * 10/1992 Forster ..... A47B 19/08 248/460
5,915,659 A * 6/1999 Scannell, Jr. ..... A47B 19/06 248/371
2012/0223209 A1* 9/2012 Baylor ..... A47B 19/08 248/460
2014/0318992 A1* 10/2014 Morelli Carullo ..... B65D 5/327 206/6.1

FOREIGN PATENT DOCUMENTS

DE 29705024 U1 * 6/1997 ..... A47B 19/08

OTHER PUBLICATIONS

"EZ Speak Folding Lectern," ampli.com. https://www.ampli.com/sale/w272.aspx [Date accessed: Jun. 15, 2021].

* cited by examiner

*Primary Examiner* — Nathan J Jenness
*Assistant Examiner* — Jessica Kavini Tamil
(74) *Attorney, Agent, or Firm* — Michael J. Feigin, Esq.; Feigin and Fridman LLC

(57) ABSTRACT

A flat foldable carrying case with a closed interior space is unfoldable to yield a lectern. The lectern/carrying case is formed from a box as well as left, right, bottom, and top flaps. The box has four sides which are connected to a back side, each at a right angle thereto. Each side of the box is rotatably adjoined to a respective side flap. The bottom flap is foldable after the sometimes identically sized left and right flaps fold into the box. Then the top flap is foldable. In some cases, the bottom flap is only foldable towards the box after the left and right flags are folded due to a wider bottom flap compared to the side flaps. In a folded condition with enclosed interior space, the top flap is parallel to the back side of the box.

12 Claims, 9 Drawing Sheets

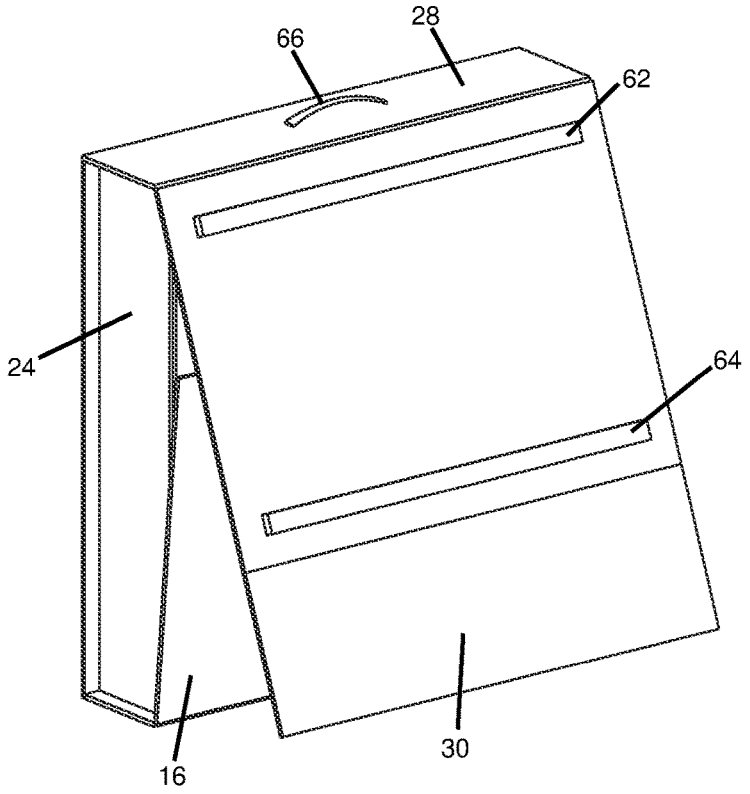
Figure 3
Figure 4
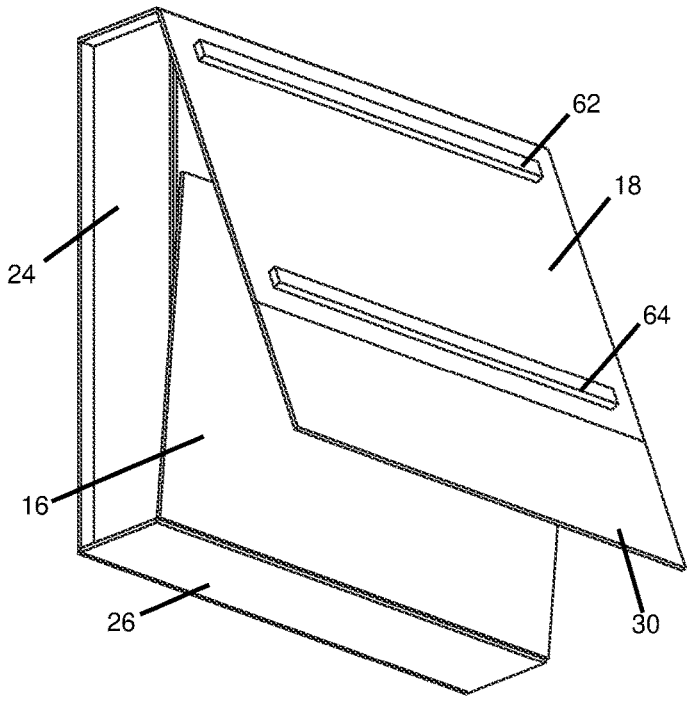

Figure 5
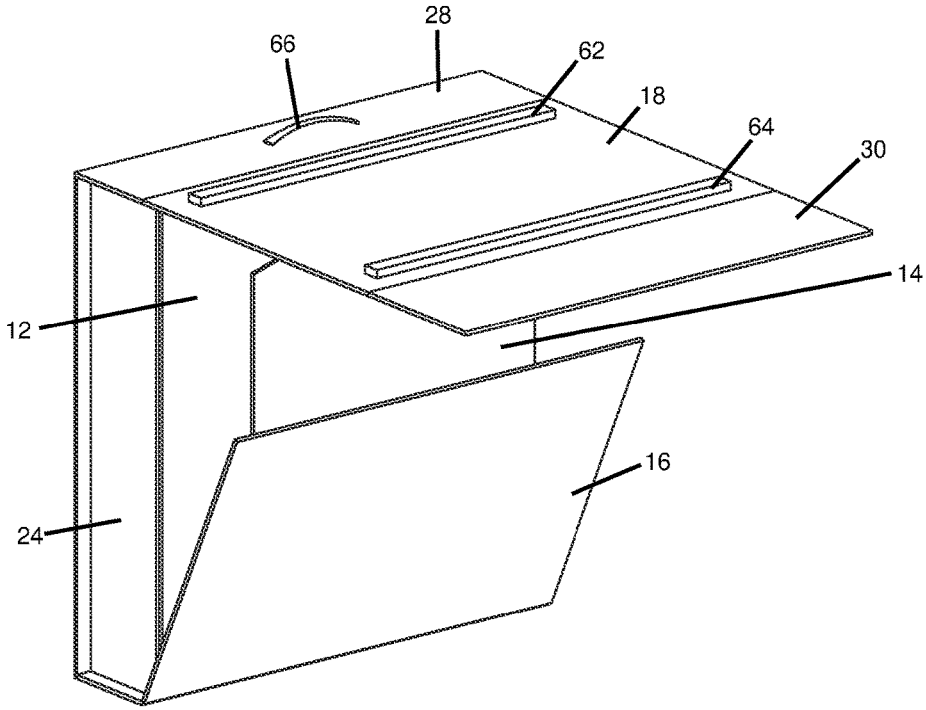
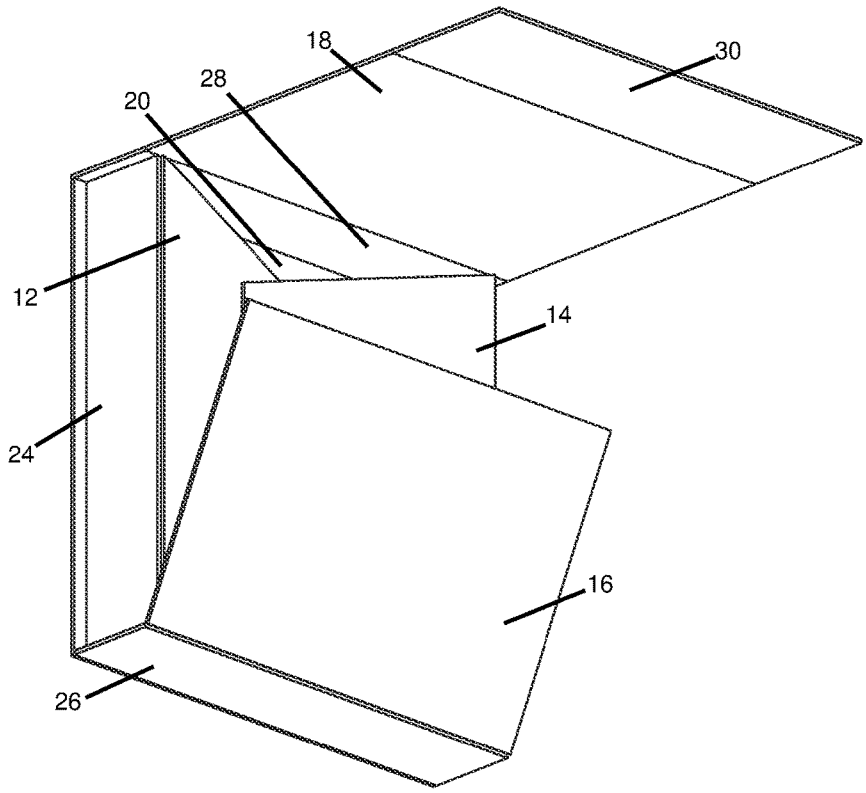
Figure 6

FLAT FOLDABLE LECTERN AND ENCLOSED BRIEFCASE

FIELD OF THE DISCLOSED TECHNOLOGY

The disclosed technology relates generally to lecterns and more specifically to a flat foldable lectern with a carrying case configuration.

BACKGROUND

Briefcases are used to store materials during transport between locations. Typically the cases are enclosed on all sides during transport. A hinge is typically used to allow the briefcase to unfold into two separate components, connected by the hinges. Objects can then be placed therein and the sides of the briefcase closed to store the objects therein. The user can subsequently utilize the same hinge securement system to close the briefcase once more.

Lecterns are elevated podiums with slanted tops that are used to hold reading material in place. Typically, the top contains devices to aid in the securement of the placement of the reading material. Lecterns are used by speakers, instructors, lecturers, students, and the like.

While it is known in the art that some lecterns can be foldable, there is room for improvement on the technology. The advantages of both a lectern and carrying case are needed including the strength and versatility of each.

SUMMARY OF THE INVENTION

A flat foldable carrying case with a closed interior space is unfoldable to yield a lectern. The lectern/carrying case is formed from a box as well as left, right, bottom, and top flaps. The box has four sides which are connected to a back side, each at a right angle thereto. Each side of the box is rotatably adjoined to a respective side flap. The bottom flap is foldable after the sometimes identically sized left and right flaps fold into the box. Then the top flap is foldable. In some cases, the bottom flap is only foldable towards the box after the left and right flags are folded due to a wider bottom flap compared to the side flaps. In a folded condition with enclosed interior space, the top flap is parallel to the back side of the box.

In some embodiments of the lectern, the top flap and flange are connected to one another on the side of the flap distal to the box. This top flap and flange, as well as the six sides of the box, form a closed interior space within the box. The interior distance between the back side and top flap is substantially equal to the distance between the back side of the box and the top flange.

In some embodiments of the technology, when the flat foldable lectern is unfolded into a "lectern configuration," the top flange possesses a non-planar positional relationship with the top flap of the box, while the bottom flap is parallel and maintains planar consistency with the bottom of the box. In "lectern configuration," when the interior space is formed by the unfolding of the lectern components, the rotatable top flange abuts the left and right flaps. Additionally, there is only one portal into the interior space of the lectern in this embodiment of the disclosed technology. The lips of the rotatable top flange and bottom flap as well as parts of the left and right flaps form the only entryway to the portal.

In some embodiments, the top flange comprises a plurality of magnets, each magnet being adjacent to the lip of the top flange. The lips of the left and right flaps also have magnets placed correspondingly relative to each other. The attraction of the magnets of the top flange to the magnets of said left and right flaps is designed to render and/or does cause the angle formed between the top flap and back side of the box changeably holdable. The lectern's rotatable top flange may comprise magnets at a distal lip, while the bottom flap comprises magnets at a proximal end (relative to the bottom side of the box). The magnets of the rotatable top flange and the bottom flap are positioned to hold the box's sides, flaps, and flange rigidly when the lectern is in an assembled configuration.

The top flange can be magnetically connected to the front lips of the left and right flaps. The top flange can also or instead be designed to be magnetically disconnected and pulled away from the front lips of the left and right flaps, and magnetically reattached to the top lips of the left and right flaps, thus changing the angle of the top flap relative to the back side.

A single portal opening may be found into an interior space of the lectern, whose perimeter is defined by the edges of the bottom and top flaps, as well as part of the edges of the left and right flaps. This single portal may be on the front side of the lectern. Upon folding the lectern, the top flap and top flange form the "front side" of the lectern, substantially closing the interior space on all sides. In the folded condition, the front and back sides of the lectern are parallel to each other.

"Box" is defined as "an item comprising or consisting of a rigid planar side secured to perpendicular sides, at least partially enclosing an interior space."

"Foldable" is defined as "possessing the ability of two parts or subcomponents designed to be repeatedly rotatable with respect to one another while maintaining the original physical shape and dimensions of parts being folded relative to one another."

"Repeatedly" is defined as "at least 100 times without the aid of tools or noticeable physical degradation of a product."

"Lectern" is defined as "a stand with a repeatedly and changeably orientable top."

"Side" is defined as "a planar region of the lectern."

"Rotatably attached" is defined as "lectern components secured to one another in a manner whereby an angle of components is designed to be changed with reference to each other repeatedly."

"Flap" is defined as "a lectern side rotatably attached to another lectern component."

"Closed" is defined as "substantially covered on all sides."

"Substantially" is defined as "at least 95% of term being described."

"Interior space" is defined as "an area mostly or fully circumscribed and/or closed by parts of the lectern."

"Portal" is defined as "a purposefully designed opening into an otherwise closed interior space."

"Correspondingly placed" is defined as "located at an equal offset from a centerline of a side or flange of the lectern."

"Edge" is defined as "a linear or substantially linear region contained between two larger, oppositely disposed, elongated planar regions."

"Rigid" is defined as "retains shape during intended use."

"Adjacent" is defined as "less distant in length than 10% of the total length of a lectern flange or side."

"Lip" is defined as "edge."

"Identical" is defined as "what an ordinary observer would consider to be the same and/or within an acceptable tolerance level of the industry."

"Lectern configuration" is defined as "the orientation of the lectern, in which the flaps and flanges are fully unfolded, that enables said technology to be used for the placement of reading material."

The directional descriptors used in this disclosure, such as "top", "bottom", "vertical", "horizontal", "upper", "lower", "above", and "below" are relative to a typical direction of use.

Any device or step to a method described in this disclosure can comprise, or consist of, that which it is a part of, or the parts which make up the device or step. The term "and/or" is inclusive of the items which it joins linguistically and each item by itself.

BRIEF DESCRIPTIONS OF THE FIGURES

FIG. 3 is a version of the foldable lectern of FIG. 1, with a top flap thereof being unfolded.

FIG. 4 is a version of the foldable lectern of FIG. 2, with the top flap thereof being unfolded.

FIG. 5 is a version of the foldable lectern of FIG. 3, with a bottom flap thereof being unfolded and the top flap in a lectern configuration.

FIG. 6 is a version of the foldable lectern of FIG. 4, with the bottom flap thereof being unfolded and the top flap in a lectern configuration.

DETAILED DESCRIPTION

A flat foldable carrying case with a closed interior space is unfoldable to yield a lectern. The lectern/carrying case is formed from a box as well as left, right, bottom, and top flaps. The box has four sides which are connected to a back side, each at a right angle thereto. Each side of the box is rotatably adjoined to a respective side flap. The bottom flap is foldable after the sometimes identically sized left and right flaps fold into the box. Then the top flap is foldable. In some cases, the bottom flap is only foldable towards the box after the left and right flags are folded due to a wider bottom flap compared to the side flaps. In a folded condition with enclosed interior space, the top flap is parallel to the back side of the box.

Embodiments of the disclosed technology will become more clear in view of the following description of the figures.

Figure 1:
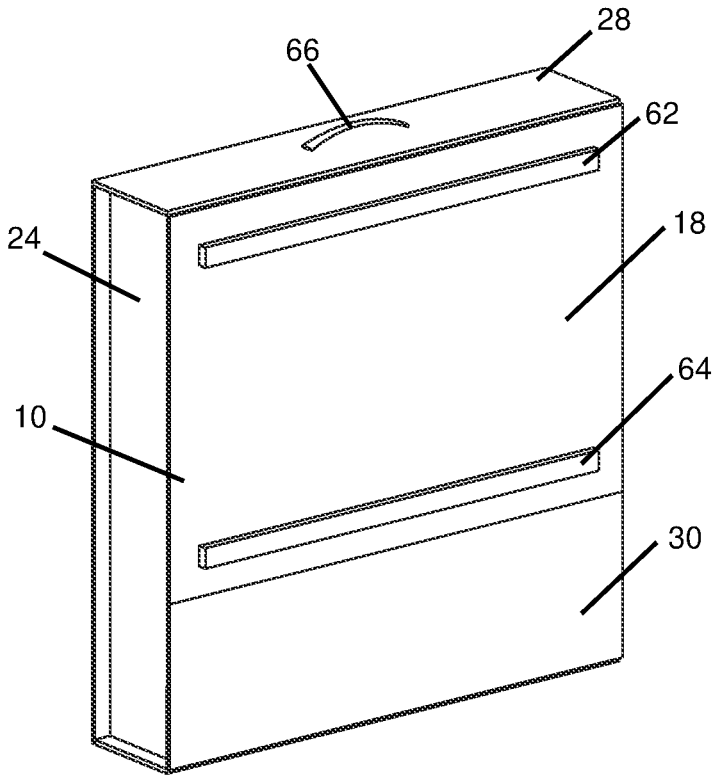
FIG. 1 is a top and front side perspective view of the foldable lectern in a carrying case configuration in an embodiment of the disclosed technology.
Figure 2:
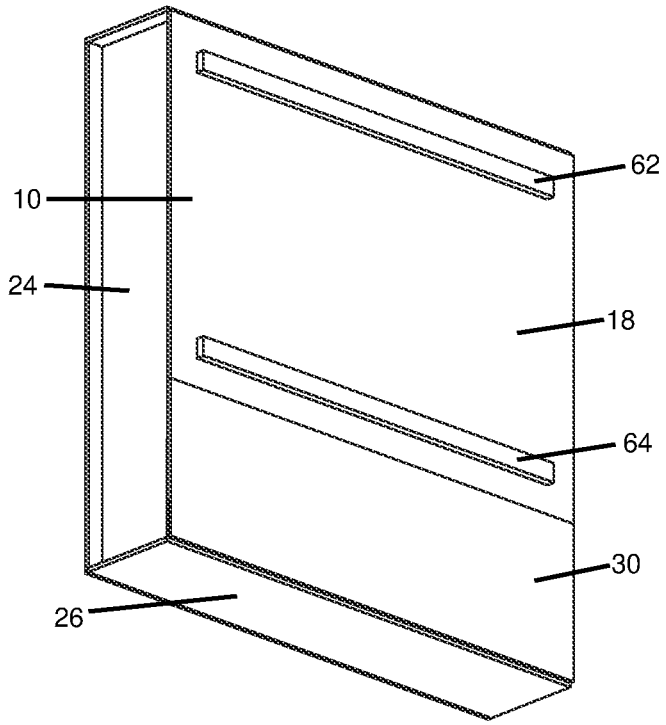
FIG. 2 is a bottom and back side perspective view of the foldable lectern in a carrying case configuration in an embodiment of the disclosed technology.

FIG. 1 is a top and front side perspective view of the foldable lectern in a carrying case configuration in an embodiment of the disclosed technology. FIG. 2 is a bottom and back side perspective view of the foldable lectern in a carrying case configuration in an embodiment of the disclosed technology. Discussing FIG. 1 and FIG. 2 simultaneously, a handle 66 is on a top side 28 of a box 10. The box has sides 24 and 26 (and further sides which are shown/discussed with reference to figures below). In addition, a rotatably attached planar outcropping an/or extension from the top side 28 of the box is flap 18. The top flange 30, a rotatably attached planar outcropping to flap 18 is also shown. The lectern also comprises placement holders 62 and 64, which are laterally placed, parallel strips of material, raised from the surface of 18. The placement holders prevent a book or other object placed on the top flange 30 from sliding downwards past the a placement holder, in a lectern configuration shown in later figures.

In a carrying case configuration, handle 66 is usable to hold and move the case/lectern while the carrying case remains closed. Further, the carrying case has opposite sides which remain parallel to one another, rendering an easy to handle rectangular prism form. Aided by internal magnets, the rotatably attached top flap 18 and top flange 30 lie flat against the rest of the carrying case, aiding in the formation of a substantially or exactly (within a tolerance level acceptable in the art) rectangular prism shape.

FIG. 3 is a top and front side perspective view of the foldable lectern in a carrying case configuration, as top flap 18 and top flange 30 are in the process of being unfolded in an embodiment of the disclosed technology. FIG. 4 is a bottom and front side perspective view of the foldable lectern in a carrying case configuration, as top flap 18 and top flange 30 are in the process of being unfolded in an embodiment of the disclosed technology. Additionally depicted in FIG. 3 and FIG. 4 are box sides 24, 26, and 28, handle 66, and placement holders 64 and 66. FIG. 3 and FIG. 4 illustrate a beginning stage of a process of the lecterns unfolding, which enables the lectern to transition from a "carrying case" configuration to a "lectern" configuration. While the carrying case configuration allows storage and transport therein, the lectern configuration allows support for an object on the sloped top flap 18/top flange 30 as well as storage within the lectern.

FIG. 5 is a top and front side perspective view of the foldable lectern in a transitional configuration, while FIG. 6 is a bottom and front side perspective view of the foldable lectern in a transitional configuration. The transitional configuration is a state where the elements of the device 10 are partially in, or between, a lectern and carrying case configuration. In both FIG. 5 and FIG. 6, the top flap 18 and top flange 30 are shown fully unfolded into their respective positions, which will allow for side flaps 12 and 14 to be unfolded into their proper positions for lectern configuration, without top flap and top flange 18 and 30 respectively interfering with this process. Bottom flap 16 is partially unfolded. Box flaps 12, 14, 16, and 18 comprise a system in which one of the side flaps 12 or 14 must be folded over the other respective side flap and only then can bottom flap 16 be folded inwards. This is because the flaps vary in length, as well as their respective securement placements with respect to the box. Following these steps, the top flap and flange 18 and 30 respectively can be folded downwards over the other stowed flaps. This storage system thus allows for a method by which all four flaps can be folded inwards to transition the lectern to "carrying case" configuration, or folded outwards to yield the process of transitioning the lectern into functional "lectern" configuration. Additionally depicted are box sides 20, 24, 26, and 28, placement holders 62 and 64, and handle 66.

Figure 7:
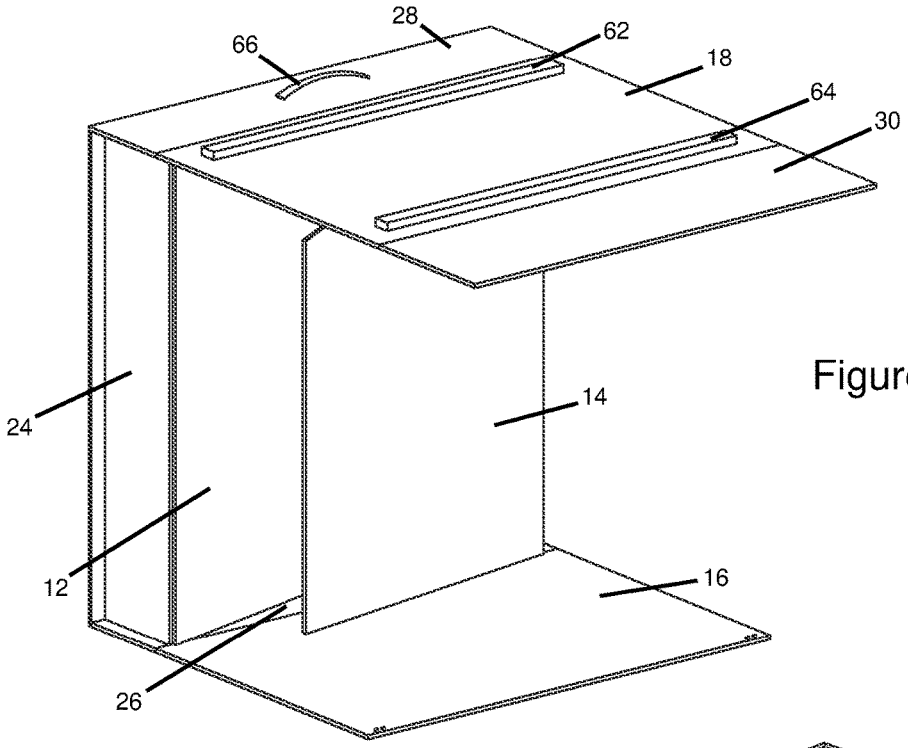
FIG. 7 is a version of the foldable lectern of FIG. 5, with the bottom flap and top flap in a lectern configuration.
Figure 8:
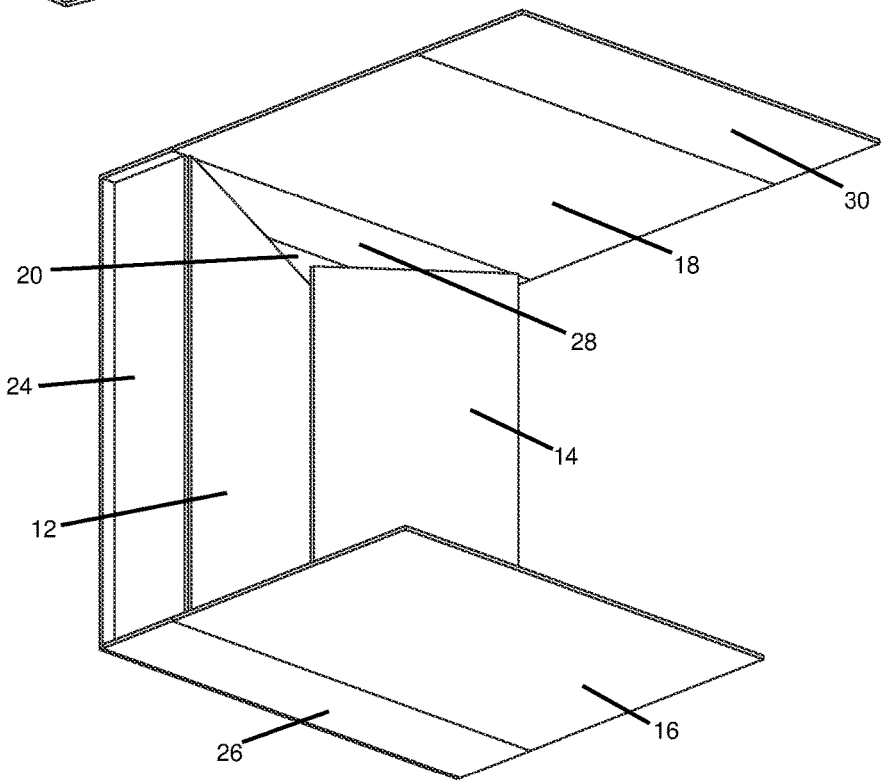
FIG. 8 is a version of the foldable lectern of FIG. 6, with the bottom flap and top flap in a lectern configuration.

FIG. 7 is a top and front side perspective view of the foldable lectern in a transitional configuration, while FIG. 8 is a bottom and front side perspective view of the foldable lectern in a transitional configuration. In both FIG. 7 and FIG. 8, top flap 18 and top flange 30 are shown fully unfolded into their respective positions, which will allow for side flaps 12 and 14 to be unfolded into their proper positions for lectern configuration, without top flap and top flange 18 and 30 respectively interfering with this process. Bottom flap 16 is completely unfolded for the eventual completion of the transition of the lectern into lectern configuration. Additionally depicted are box sides 20, 24, 26, and 28, placement holders 62 and 64, and handle 66.

Figure 9:
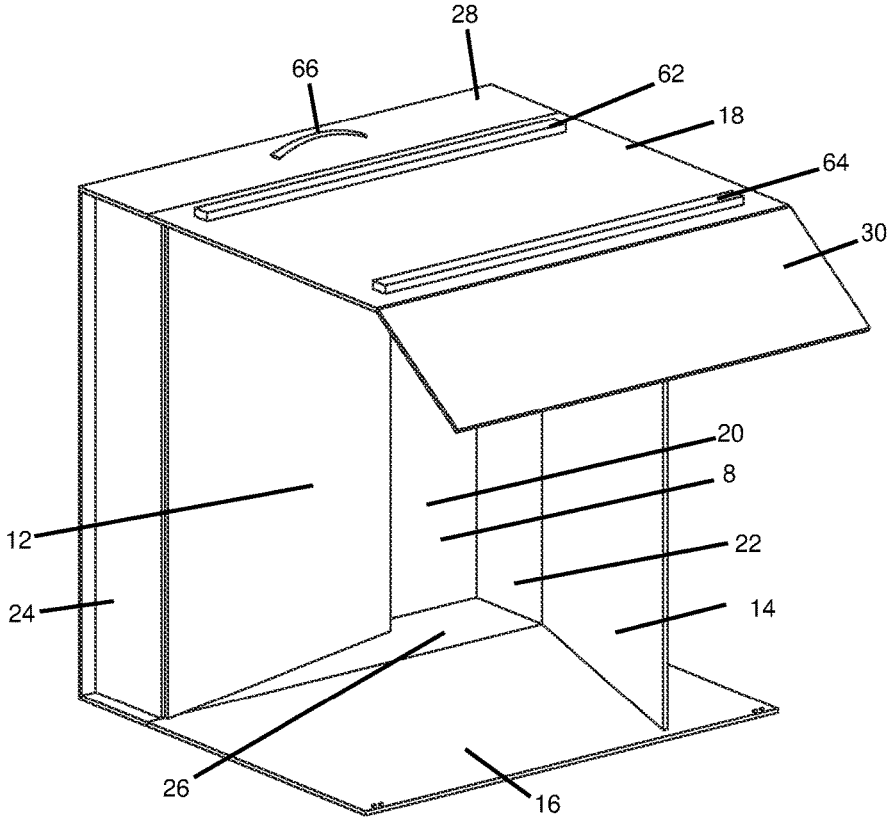
FIG. 9 is a version of the foldable lectern of FIG. 7, with a right flap partially unfolded and a top flange in a non-planar orientation relative to a top flap.
Figure 10:
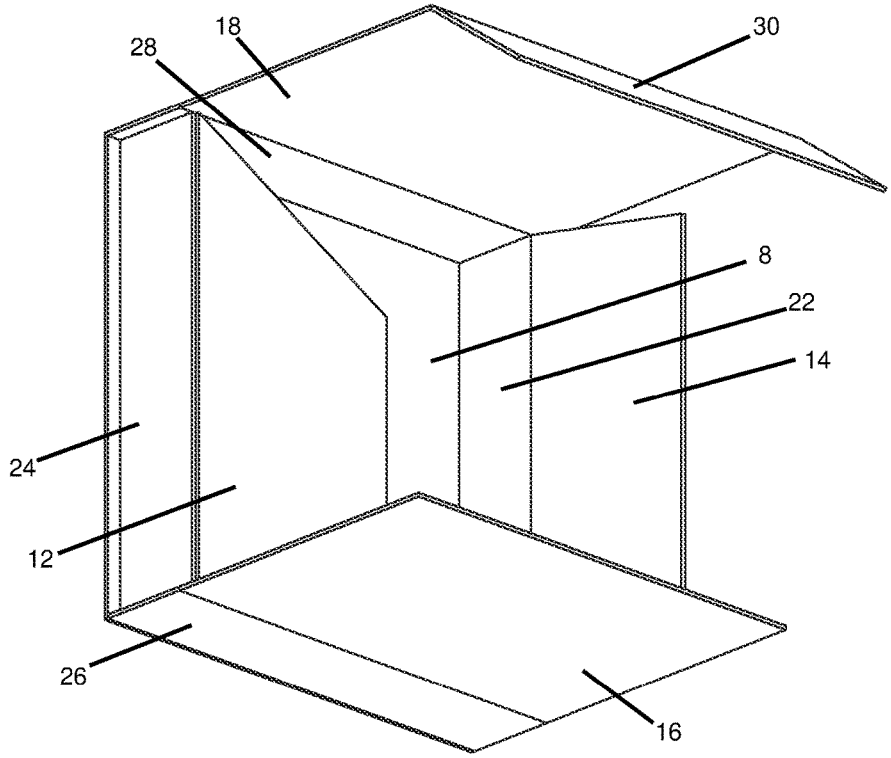
FIG. 10 is a version of the foldable lectern of FIG. 8, with a right flap partially unfolded and a top flange in a non-planar orientation relative to a top flap.

FIG. 9 is a top and front side perspective view of the foldable lectern in a transitional configuration, while FIG. 10 is a bottom and front side perspective view of the foldable lectern in a transitional configuration. In both FIG. 9 and FIG. 10, top flap 18 is shown fully unfolded, which will allow for side flaps 12 and 14 to be unfolded into their proper positions for lectern configuration, without top flap 18 interfering with this process. Flap 14 is depicted as partially open, whereas flap 12 is still entirely closed. Top flange 30 is depicted sloping downwards at an angle demonstrative of the capabilities of the rotationally attached components. In further figures, top flange 30 will be depicted in other configurations to further illustrate this capability.

Additionally depicted are box sides 20, 24, 26, and 28, placement holders 62 and 64, and handle 66.

Figure 11:
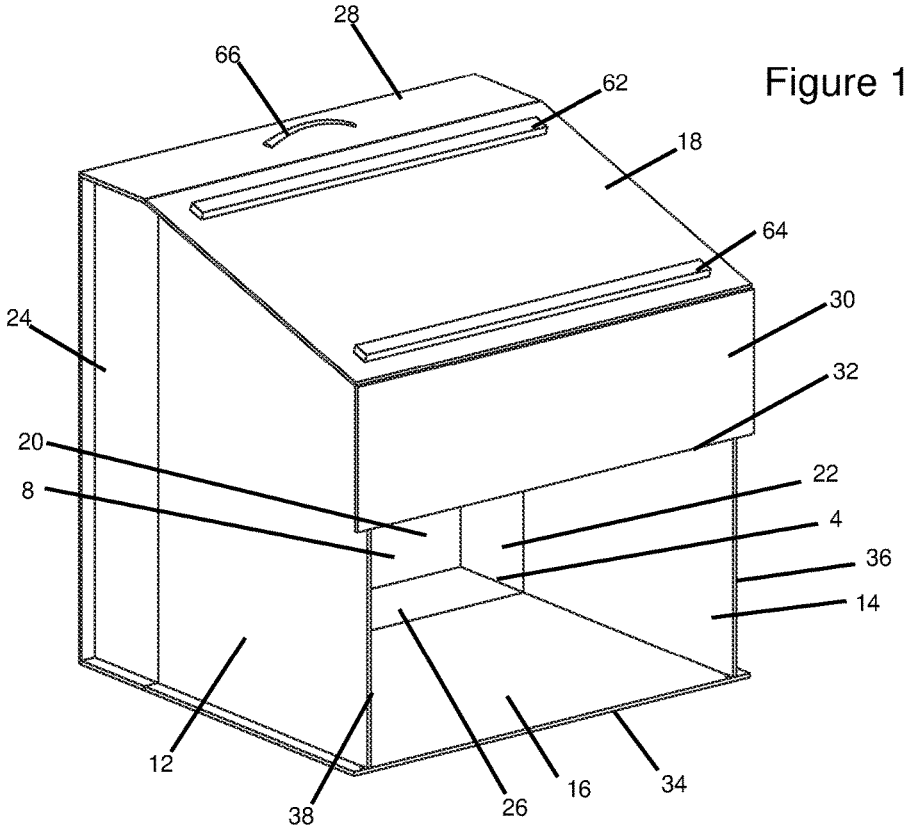
FIG. 11 is a version of the foldable lectern of FIG. 1, in a lectern configuration.
Figure 12:
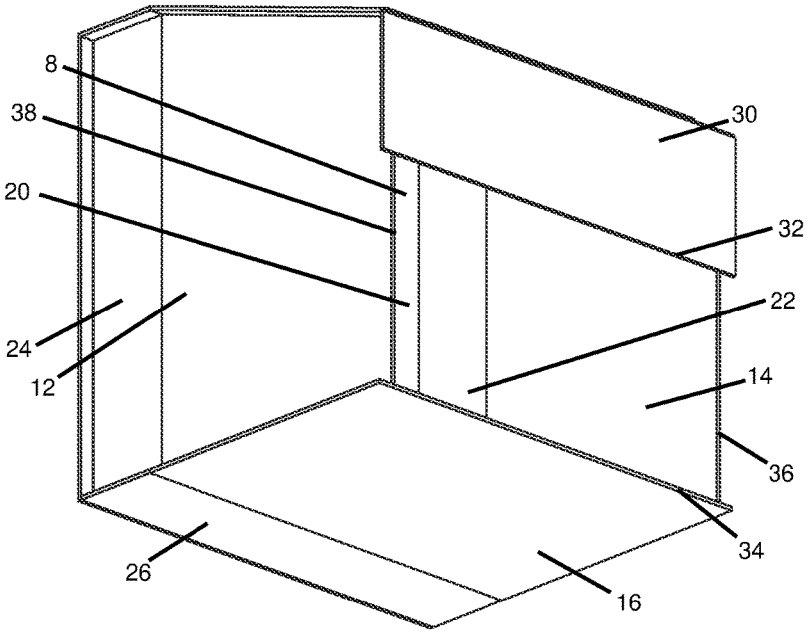
FIG. 12 is a version of the foldable lectern of FIG. 2, in a lectern configuration.

FIG. 11 is a top and front side perspective view of the foldable lectern in lectern configuration, while FIG. 12 is a bottom and front side perspective view of the foldable lectern in lectern configuration. In both FIG. 11 and FIG. 12, flaps 12, 14, and 16 are shown to be open to the full extent intended for the transition to and usage of the lectern configuration. Flap 18, which is rotationally attached to box side 28 and top flange 30, is shown sloping downwards. This is to enable the user of the lectern to utilize the surface of flap 18 for the placement of reading material and secure it between placement holders 62 and 64. Top flange 30 is positioned such that its height (the dimension of the flange bisected by an imaginary transversal spanning from flap 12 to flap 14) is perpendicular to the ground. Components 32, 34, 36, and 38, which are the lips of their respective flaps or flanges, comprise the boundaries of portal 4 which leads to interior space 8. The portal is open only on a side of the lectern in embodiments of the disclosed technology. This portal has a substantially rectangular shape. The partition of interior space 8 from the environs outside the lectern by means of the placement of the aforementioned and described further below. The lectern components give interior space 8 functionality as an area of storage for the user of the lectern. Box sides 20, 22, 24, 26, and 28 are depicted, as well as placement holders 62 and 64, and handle 66.

Figure 13:
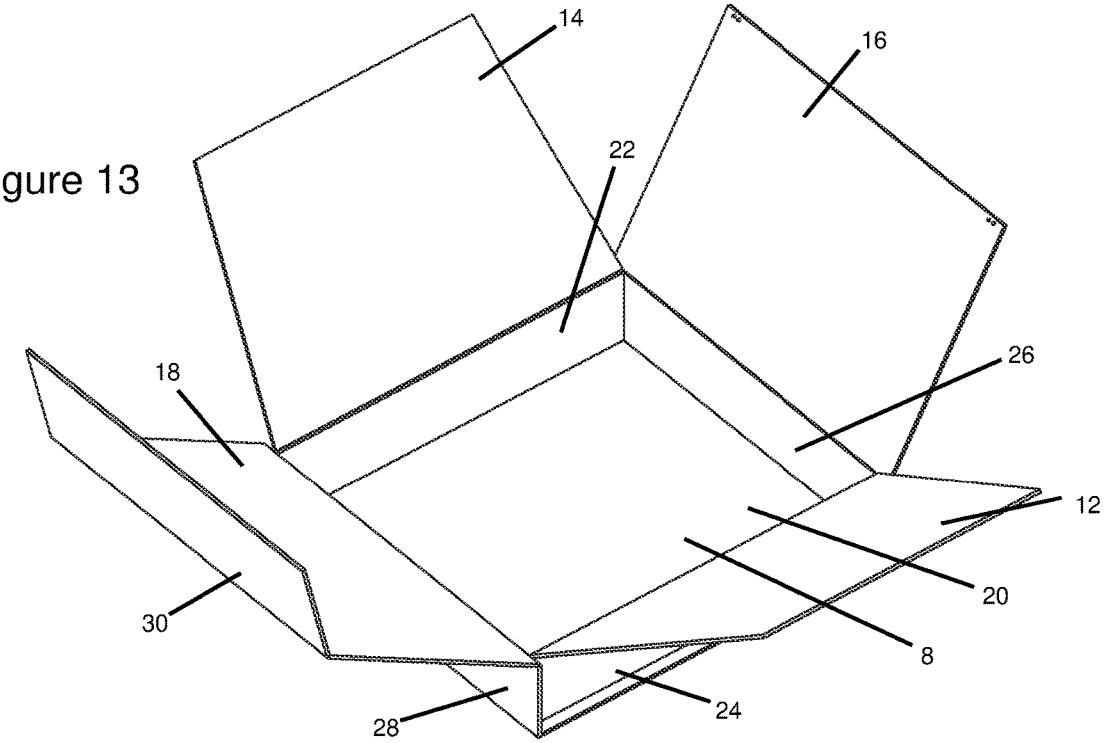
FIG. 13 is a top and front side perspective view of the foldable lectern in a transitory unfolded configuration in an embodiment of the disclosed technology.
Figure 14:
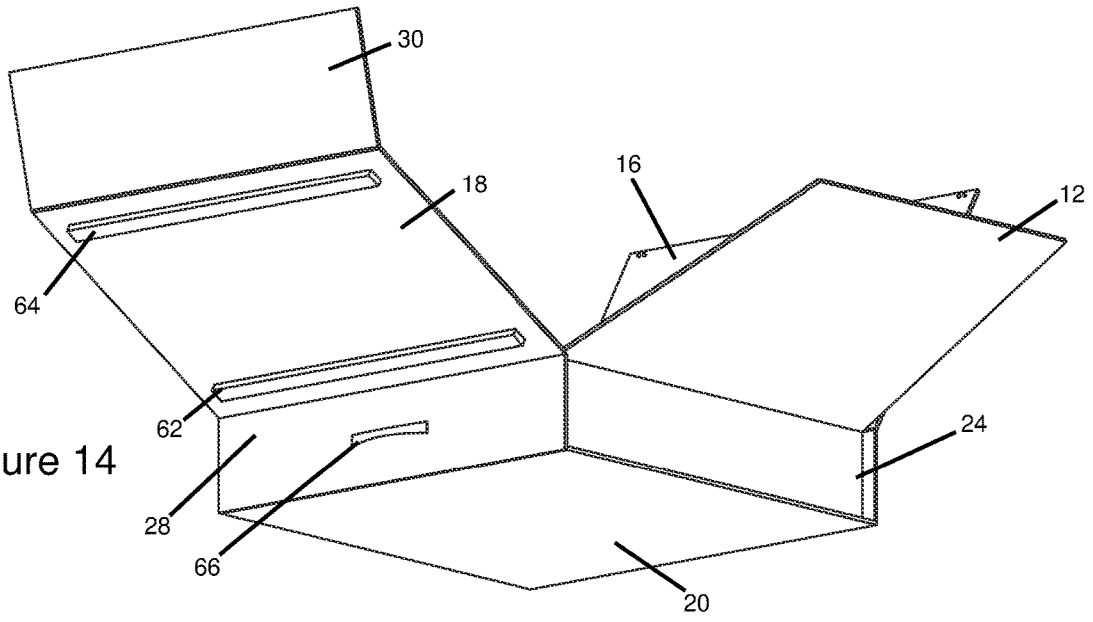
FIG. 14 is a bottom, front, and side perspective view of the foldable lectern in a transitory unfolded configuration in an embodiment of the disclosed technology.

FIG. 13 is a top and front side perspective view of the foldable lectern in a transitory unfolded, while FIG. 14 is a bottom, front, and side perspective view of the foldable lectern in a transitory unfolded configuration in an embodiment of the disclosed technology. In both FIG. 13 and FIG. 14, box sides 20, 22, 24, 26, and 28 are shown. Flaps 12, 14, 16, and 18 are rotationally secured to their respective box sides. Depicted are the rotational capabilities of these flaps, as in FIG. 13 and FIG. 14 the flaps are rotated outwards even more than that which is necessary for both the carrying case and lectern configurations. Also depicted are top flange 30, placement holders 62 and 64, and handle 66.

Figure 15:
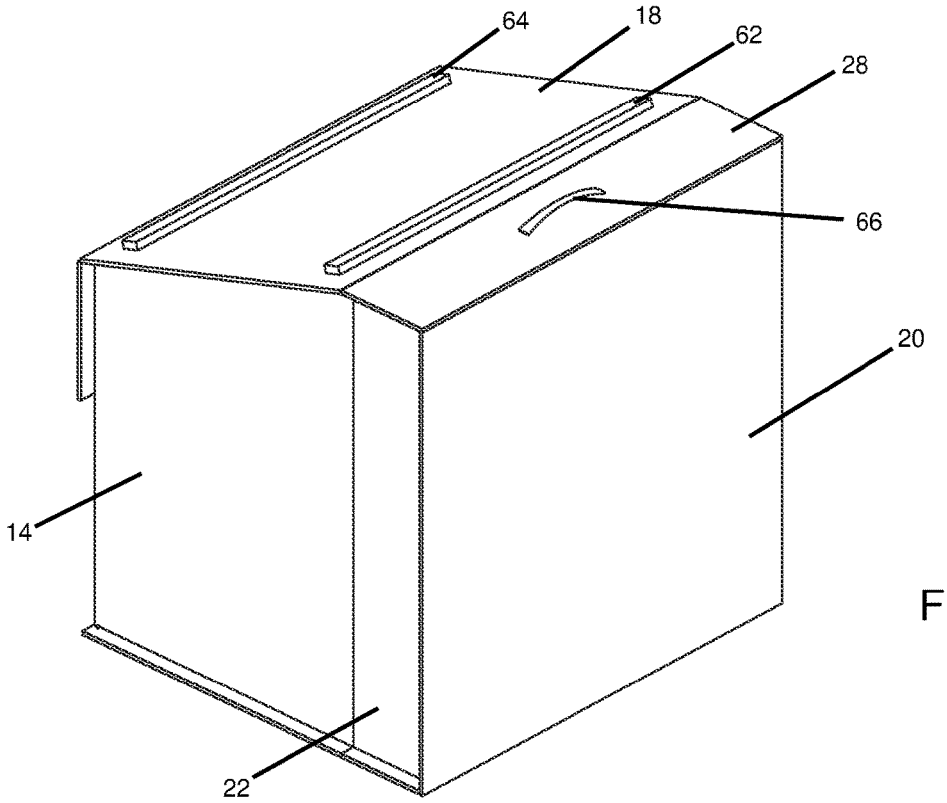
FIG. 15 is a top, back, and side perspective view of the foldable lectern in a lectern configuration in an embodiment of the disclosed technology.
Figure 16:
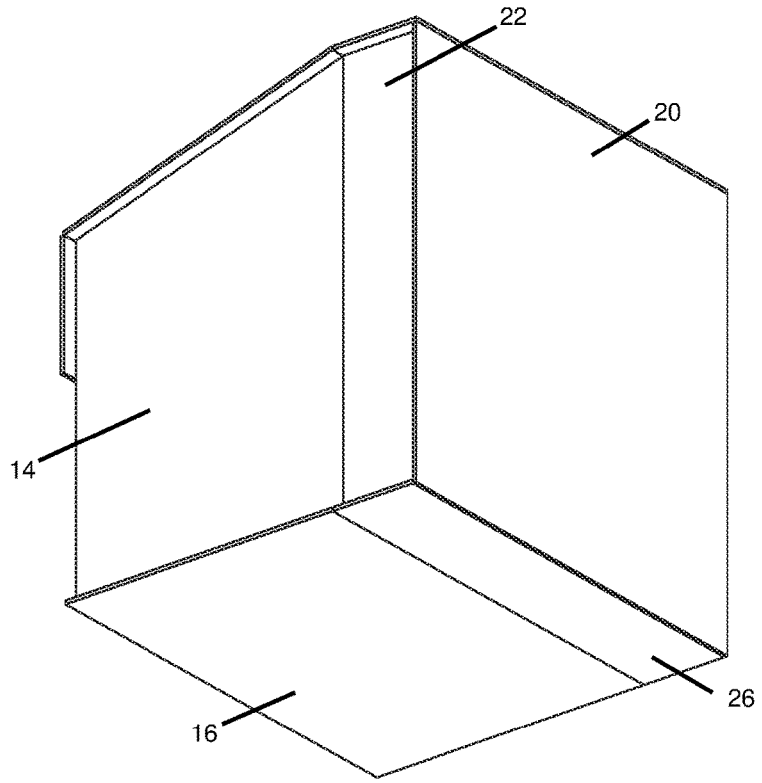
FIG. 16 is a bottom, back, and side perspective view of the foldable lectern in a lectern configuration in an embodiment of the disclosed technology.

FIG. 15 is a top, back, and side perspective view of the foldable lectern in a lectern configuration, while FIG. 16 is a bottom, back, and side perspective view of the foldable lectern in a lectern configuration in an embodiment of the disclosed technology. Depicted is the rigid construction of the unfolded flaps 12, 14, 16, and 18 and the box sides 20, 22, 26, and 28. Placement holders 62 and 64 are present, as well as handle 66.

Figure 17:
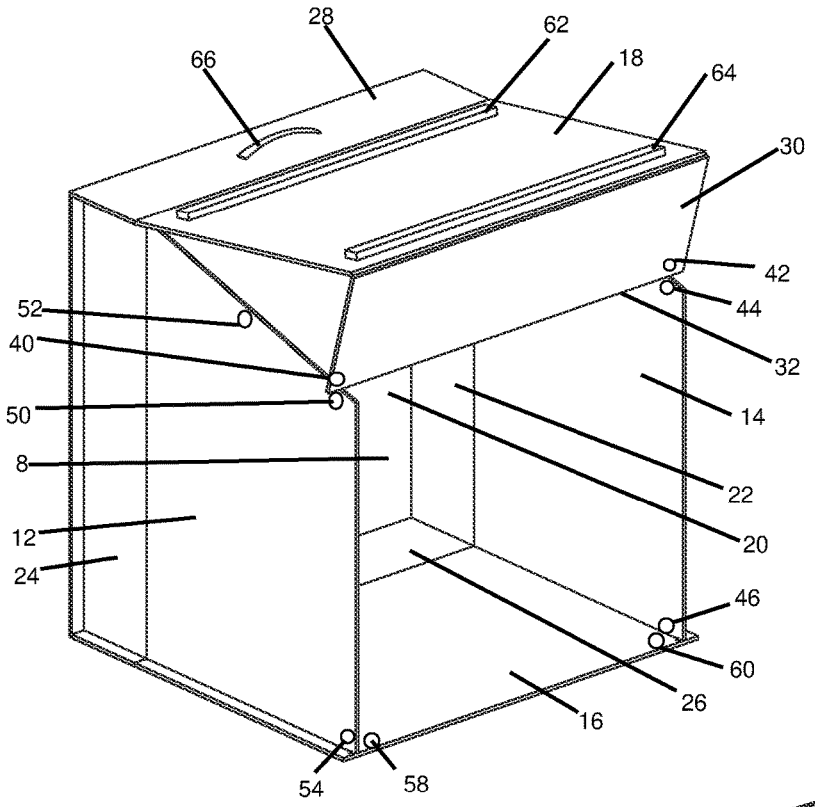
FIG. 17 is a version of the foldable lectern in FIG. 11, with an elevated top.
Figure 18:
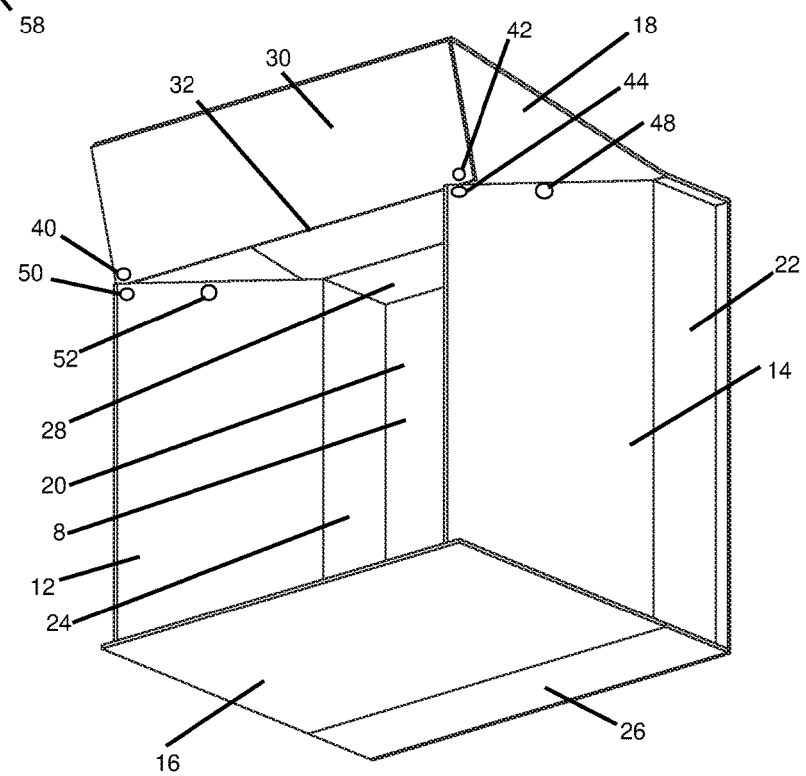
FIG. 18 is a version of the foldable lectern in FIG. 12, with an elevated top.

FIG. 17 is a version of the foldable lectern with an elevated top from a front, side, and top perspective view, while FIG. 18 is a version of the foldable lectern with an elevated top from a front, side, and bottom perspective view. Both FIG. 17 and FIG. 18 depict flange 30 resting upon flaps 12 and 14, the point of contact between the flaps and the flange being the lip of the flange, which is component number 32. The angle formed between the back box wall 20 and the top flange is obtuse. This change is designed to allow the user of the lectern to be able to angle their reading material, which is stored between placement holders 62 and 64, in multiple orientations. Magnets 40, 42, 44, 46, 48, 50, 52, 54, 56, 58, and 60 which are embedded within flaps and flange 12, 14, 16, 18, and 30, are located adjacent to the lips of their respective flaps and flange respectively. Due to the dual placement of pairs of magnets within each respective side flap 12 and 14, even more possible orientations/elevations of the top flap 18 and flange 30 are possible. Each magnet is placed correspondingly to another magnet, thus enhancing the symmetry of this embodiment of the technology. Also depicted are handle 66 and walls 22, 24, 26, and N28.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalence of the claims are to be embraced within their scope. Combinations of any of the methods, systems, and devices described herein-above are also contemplated and within the scope of the disclosed technology.

I claim:

1. A device flat foldable lectern formed from comprising:

a box with back side, a right side, a left side, a top side, and a bottom side, and four sides each of the right, left, top, and bottom sides being non-rotatably fixed at a right angle to said back side;

a left flap and right flap directly and rotatably attached to a respective said left side and right side of said four sides;

a right flap rotatably attached to said right side;

a planar bottom flap directly and rotatably attached to said bottom side; and a planar top flap directly and rotatably attached to said top side, wherein, in a carrying-case configuration of said device, said left flap and said right flap are adapted to fold into said box, and said bottom flap is adapted to fold to abut said right and left sides and to cover two a largest face of each of said left flap and said right flap when they are folded into said box, and said top flap over is adapted to be folded over said bottom flap and to abut said left side and said right side, thereby to form a hollow of the carrying case, said hollow being defined between said back side, said top side, said bottom side, said right side, said left side, and said top and bottom flaps, and being adapted to accommodate an object, other than said left flap and said right flap, therein, for carrying of the object, and in a lectern configuration of said device, said bottom flap is coplanar with said bottom side, said right flap is coplanar with said right side, said left flap is coplanar with said left side, and said top flap abuts upper lips of said right flap and said left flap, to form a lectern surface, and to convert the device between the carrying-case configuration and the lectern configuration, each of said right flap, said left flap, said top flap, and said bottom flap is adapted to be rotated relative to a corresponding one of said right side, said left side, said top side, and said bottom side of said box;

wherein a planar top flange is rotatably and directly attached to a distal side of said top flap, relative to said top side, such that said top flap is disposed between said top side and said top flange.

2. The device of claim 1, wherein, in said carrying-case configuration of said device, a first distance between said back side and said top flap is substantially equal in length and substantially parallel to a second distance between said back side and said bottom flap, said top flap and said bottom flap both being parallel to said back side, such that in the carrying-case configuration, said device forms a substantially rectangular briefcase.

3. The device of claim 1, wherein, in said lectern configuration said top flange is non-planar with said top flap and abuts front ends of said right and left flaps; and wherein, in said lectern configuration, an interior space of said lectern is defined by said back, right, left, top, and bottom sides, said bottom flap, said left flap, said right flap, said top flap, and said rotatable top flange.

4. The device of claim 3, wherein, in said lectern configuration, there is only one portal into said interior space, said only portal being bordered by a lip of said top flange, a portion of said front end of each of said right and left flaps, and a lip of said bottom flap, and wherein said device is devoid of a mechanism for closing said only one portal.

5. The device of claim 4, wherein:

said top flange comprises a plurality of magnets, each adjacent to said lip of said top flange; and said upper lip of each of said left flap and said right flap has magnets, correspondingly placed relative to each other.

6. The device of claim 5, wherein, when in said lectern configuration, an angle of said top flap relative to said back side is changeable by changing a position of said magnets of said top flange to from engaging a first pair of magnets in said left flap and said right flap to engaging a second pair of magnets of said left flap and said right flap.

7. The flat foldable lectern device of claim 1, wherein:

said top flange comprises magnets disposed at a distal lip thereof;

said bottom flap comprises magnets at a proximal end thereof, adjacent said bottom side; and in said carrying-case configuration, said magnets of said top flange are adapted to engage said magnets of said bottom flap thereby to hold said top flange and said bottom flap in place relative to one another.

8. The device of claim 3, wherein, in said lectern configuration, said top flange is devoid of a portion extending in parallel to said bottom flap.

9. The device of claim 3, wherein, in said lectern configuration, an obtuse angle is formed between the top flap and the top flange, measured from within said interior space, and a reflex angle is formed between the top flap and the top flange when measured from outside of the interior space.

10. The device of claim 1, wherein said top flange comprises a single planar surface.

11. The device of claim 1, wherein said top flap has at least one placement holder disposed on a broad surface thereof, such that in said carrying-case configuration said at least one placement holder faces away from said hollow, and in said lectern configuration said at least one placement holder is disposed on an upper surface of the lectern and is adapted to prevent an object placed on the top flap from slipping.

12. The device of claim 11, wherein said placement holder is disposed proximally to a distal lip of said top flap.

* * * * *